United States Patent [19]

Zollinger et al.

[11] 4,031,926

[45] June 28, 1977

[54] LOOM WITH MEANS FOR INTRODUCING THE FILLING THREADS BY MEANS OF A FLUID

[75] Inventors: Hans Zollinger, Tann-Ruti; Rolf Honegger, Durnten, both of Switzerland

[73] Assignee: Ruti Machinery Works Ltd., Ruti, Switzerland

[22] Filed: Sept. 8, 1975

[21] Appl. No.: 611,329

[30] Foreign Application Priority Data

Sept. 11, 1974 Switzerland ..... 012338/74

[52] U.S. Cl. ..... 139/435

[51] Int. Cl.[2] ..... D03D 47/30

[58] Field of Search ..... 139/35, 55, 98, 127 R, 139/127 P, 435, 188 R, 192

[56] References Cited

UNITED STATES PATENTS

| | | | |
|---|---|---|---|
| 1,721,940 | 7/1929 | Ballou | 139/127 |
| 3,161,209 | 12/1964 | Scheffel | 139/127 |
| 3,399,701 | 9/1968 | Strake | 139/127 |
| 3,447,574 | 6/1969 | Claeys | 139/192 |
| 3,465,791 | 9/1961 | Van Mullekom | 139/127 |
| 3,818,952 | 6/1974 | Vermeulen et al. | 139/127 |
| 3,901,286 | 8/1975 | Vermeulen et al. | 139/435 |

*Primary Examiner*—Henry S. Jaudon
*Attorney, Agent, or Firm*—Donald D. Denton

[57] ABSTRACT

The present invention covers a loom having means for introducing the filling threads by fluid with the means for introducing the filling threads having a comb of parallel channel forming blades to form a guide channel for the fluid, the channel forming blades arranged on the side of the reed facing the fell of the cloth.

5 Claims, 5 Drawing Figures

LOOM WITH MEANS FOR INTRODUCING THE FILLING THREADS BY MEANS OF A FLUID

BACKGROUND OF THE INVENTION

The present invention relates to a loom having means for introducing filling threads by means of a fluid, and having a reed for beating the filling thread which has just been introduced, the means for introducing the filling threads comprising a comb of parallel channel forming blades for forming a guide channel for the fluid and the filling thread to be introduced, said channel forming blades being arranged on the side of the reed facing the fell of the cloth being woven.

In known looms of this type, the comb having the channel forming blades is fastened to the lay in the vicinity of the mounting strip of the reed facing the lay's supporting and drive mechanism. Thus the channel forming blades, in the customary loom arrangement, extend in each case from the bottom between warp threads when the shed is opened and the channel forming blades emerge in each case in downward direction out of the shed when the reed moves into the beating-up position. In order to obtain a suitable fabric there are required, as is known, temples or spreaders which should be arranged at as small a distance as possible from the fell in order to prevent the cloth shrinking in the width-wise direction of the cloth at the fell and the warp threads therefore no longer extending parallel to the edge portions of the reed. It is difficult, however, with the aforementioned known arrangement for the channel forming blades to position the temples sufficiently close to the fell and nevertheless prevent collision between the channel forming blades and the spreaders. Up to now it was necessary to develop the supporting and drive mechanism of the reed in special manner so as to impart the reed upon its beating movement in addition a considerable component of movement in downward direction so that the channel forming blades can descend below the temples. However, in such an arrangement there were various disadvantages inherent herein.

In other known looms having means for introducing the filling threads by compressed air, the teeth of the reed themselves are developed as channel forming blades, each having a recess to form a guide channel for the stream of air serving for the introduction of the filling thread. The recess in each channel forming blade is, in this connection, so developed and arranged that the filling thread which has been introduced remains in each case in the guide channel during the beating-up and emerges from the guide channel only upon the subsequent rearward movement of the lay. Use of ordinary temples on these looms would result in an undesirably large distance between the fell of the cloth and the temples. In order to avoid this disadvantage, the development of the temples and the form of the reed-teeth recesses which form the air guide channel are so adapted to each other that the temples dip into the guide channel upon the beating motion of the reed. This however results in an unfavorably large cross-section of the air guide channel, at least in the vicinity of the temples, and results in a special design of the spreaders, which is less effective.

SUMMARY OF THE INVENTION

The present invention relates to a loom of the aforementioned type in which temples are arranged in the desired small distance from the fell and there is no large component of movement transverse to the beating movement imparted the reed.

This is achieved with the loom of the present invention which is characterized essentially by the fact that the comb which has the channel forming blades is arranged on the reed mounting strip which faces away from the supporting and drive mechanism of the reed.

By this surprising development, more space is obtained for the channel forming blades since the temples take up far less space on the side of the cloth facing away from the reed supporting and drive mechanism than on the opposite side. The reed and the channel forming blades connected with it therefore need carry out, in addition to their reciprocating movement, only a relatively slight movement transverse thereto in order that the channel forming blades are moved out of the shed and raised above the temples upon each beating-up.

In one suitable embodiment, each of the channel forming blades has the shape of a finger which, starting from its point of attachment, first extends substantially parallel to the reed teeth and then at its end portion moves towards the reed so that a guide channel for the fluid is formed between the blade comb and the reed and an outlet opening for the filling thread introduced is present between the free end of each channel forming blade and the reed.

As a further advantageous development, a warp thread rest rail can be arranged along the comb having the channel forming blades, said rail contacting and aligning the group of warp threads facing away from the supporting and drive mechanism of the reed when the shafts are in the open shed position and when the reed has moved away from the fell. In addition a second warp thread rest rail can be arranged stationary between the reed and the shafts, it contacting the group of warp threads facing the supporting and drive mechanism of the reed when the shafts are in the open shed position and aligning them in the same position. As a result of the said warp thread rest rail, a uniform shed is obtained over the entire width of the warp.

In still another embodiment, the warp thread rest rails arranged between the channel forming blades and the reed may have a resting edge for the warp threads which is developed stepwise in the manner of saw teeth, nozzle openings for the fluid serving for the introduction of the filling thread being arranged on the steep sides of the steps. However, it is also possible to develop some of the channel forming blades as finger-like nozzles by which a fluid serving for the introduction of the filling is introduced into the guide channel. The feeding of the fluid to the nozzles can be effected through a hollow space in the warp thread resting rail.

BRIEF DESCRIPTION OF THE DRAWINGS

These and other objects, features, details, and advantages of the invention can be noted from the claims, from the following detailed description of individual embodiments, and from the accompanying drawings which show the object of the invention purely diagrammatically and by way of example, in which drawings:

DESCRIPTION OF PREFERRED EMBODIMENTS

Figure 1:
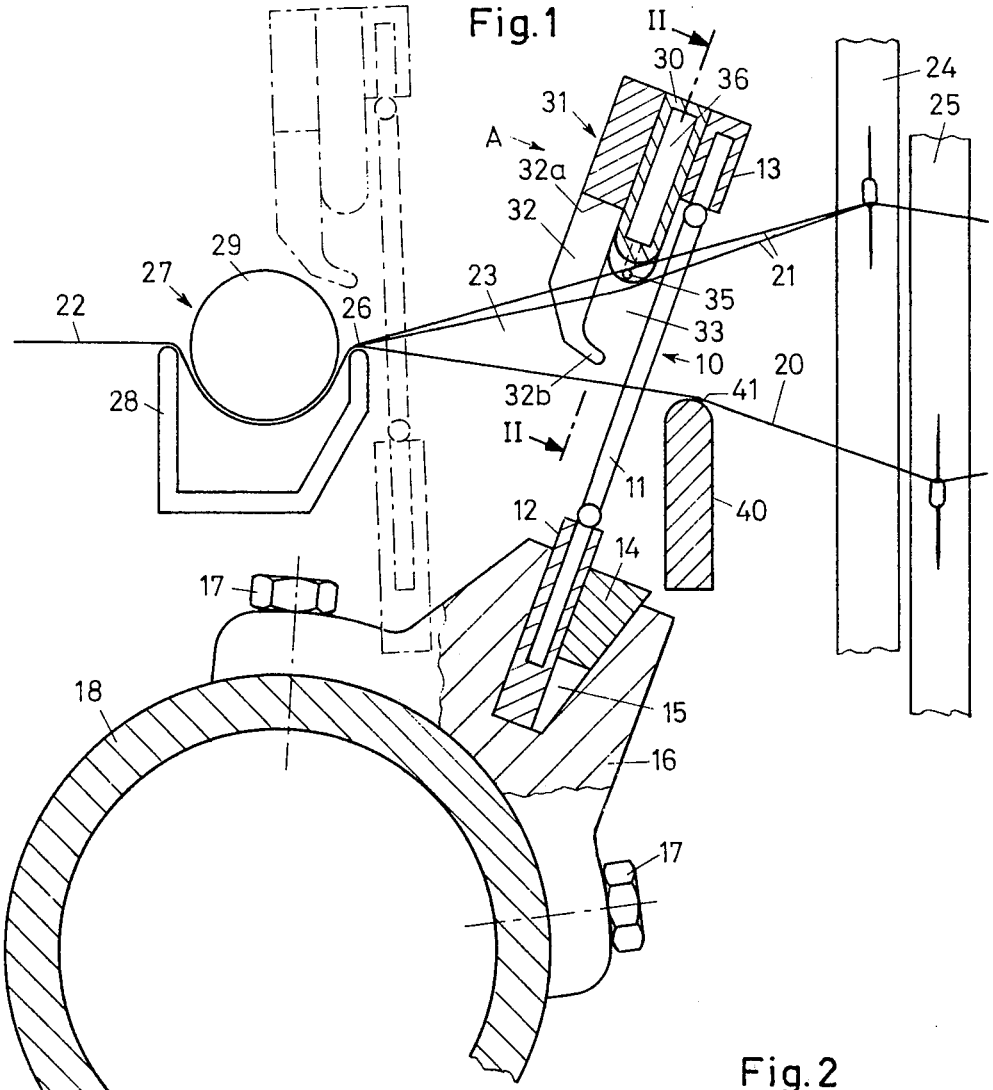
FIG. 1 shows a vertical section parallel to the warp threads, part in cross-section, of those parts of a first embodiment of the loom of the invention which are most important, with the moving parts being shown in solid line in the position which they have upon the introduction of the filling thread and in dot-dash line in the position which they have during the beating-up of the filling thread.

The loom arrangement illustrated in FIG. 1 has a reed 10 of customary type which has linearly extending teeth 11 whose ends are held in a bottom mounting strip 12 and an upper mounting strip 13. The bottom mounting strip 12 of the reed 10 is fastened by wedges 14 in a groove 15 in a holding device 16 which in turn is firmly attached by screws 17 to a hollow shaft 18. The hollow shaft 18 is rotatably supported at its ends in the machine frame (not shown) of the loom with its axis of rotation being located below the warp threads at a point forwardly of the fell of the fabric being woven. By a known drive mechanism (also not shown) the reed 10 is movable back and forth periodically between the position shown in solid lines in FIG. 1 in which the blades 32 penetrate the warp threads 21 and into the shed during weft insertion and the position shown in dot-dash lines in which the blades 32 are located above the temples 27 and the plane of the warp, a stand-still phase being possibly interposed at the position shown in solid lines.

Warp threads 20 and 21 which together with the filling threads (not shown) form the desired cloth 22 are pulled in customary manner between the teeth 11 of the reed 10. The shed 23 which is necessary for the introduction of the filling threads between a lower group of warp threads 20 and an upper group of warp threads 21 is formed in known manner means of shafts 24 and 25. The previously introduced filling thread is beaten against the cloth 22 already produced at the fell 26 by means of the teeth 11 of the reed 10, as is generally known. At a slight distance from the fell 26 there are temples or spreaders 27 of customary development, each of which has a stationary part 28 and by means of a rotating part 29 grasp the lateral portions of the resultant cloth 22 and continuously pull them towards the outside in order to stretch the cloths widthwise so that the warp threads 20 of the lower group of warp threads and the warp threads 21 of the upper group always extend parallel to the fell 26.

The above described development of the loom is entirely conventional, so that it is deemed unnecessary to go further into details.

Figure 2:
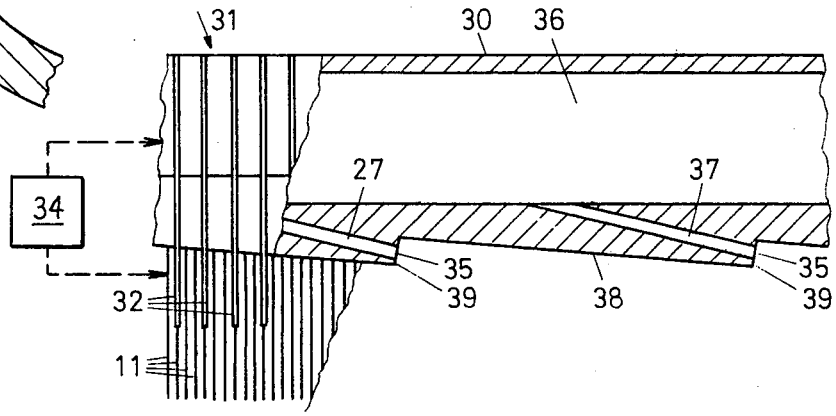
FIG. 2 shows a partial view along the line II—II of FIG. 1 in the direction of the arrow A in FIG. 1.

On the upper mounting strip 13 of the reed 10, on the side thereof facing the fell 26, there is fastened a profiled rail 30 which when the shed 23 is open is contacted by the warp threads 21 of the upper group of warp threads. The profiled rail 30 will therefore be referred to hereinbelow as the first warp thread rest rail. On the side of the warp thread rest rail 30 facing the fell 26 a comb 31 consisting of channel forming blades 32 is arranged to form a guide channel 33, lying between the teeth 11 of the reed 10 and the blades 32, for a fluid which serves for the introduction of the filling thread, such as for instance air. Each of the channel forming blades 32 has the shape of a finger which starting from its point of attachment **32*a* first of all extends substantially parallel to the reed teeth 11 and then at its end portion 32*b* extends towards the reed 10. Between the end portion 32*b* of each blade 32 and the teeth 11 of the reed 10 there is a free distance to form an outlet opening for the filling thread introduced into the guide channel 33. The number of channel forming blades 32 can be less than the number of reed teeth 11, as shown in the left in FIG. 2.**

From a fluid supply means 34 a fluid which serves for the introduction of the filling thread, for instance air, is fed into the shed 23 by means of a main nozzle (not shown) present on one side of the shed 23 and a plurality of auxiliary nozzles 35 which are arranged on the warp-thread rest rail 30. The warp-thread rest rail 30 has a hollow space 36 which passes through it in longitudinal direction, it being fed with the fluid at one end of the rail 30 via a hose (not shown) and being closed at the opposite end. The auxiliary nozzles 35 are the outlet openings of bore holes 37 which extend outward from the hollow space 36. As shown in particular in FIG. 2, the edge 38 of the warp thread rest rail 30 which comes into contact with the warp threads 21 is stepped in the fashion of saw teeth, the nozzle openings 35 being arranged in each case on the steep short step sides 39.

A second warp-thread rest rail 40 is arranged in fixed position below the warp threads between the reed 10 and the shafts 24, 25 in such a manner that a linearly extending edge 41 of the second warp-thread rest rail 40 is contacted by the warp-threads 20 of the lower group of warp threads when the shed 23 is opened.

The manner of operation of the devices for the introduction and beating-up of the filling threads which have been described is as follows:

When the reed 10 moves into its rear dead center position, i.e. into the greatest possible distance from the fell 26 of the cloth, the shed 23 is opened by means of the shafts 24 and 25. The channel forming blades 32 then engage from above into the shed 23. The warp threads 20 of the lower group of warp threads come to rest against a linearly extending edge 41 of the second warp-thread rest rail 40, whereby these warp threads 20 are all aligned in the same position. At the same time the warp threads 21 of the upper group of warp threads come to rest against the stepped edge 38 of the first warp-thread rest rail 30 whereby these warp threads 21 are so aligned in groups that fluid emerging from the nozzle openings 35 can flow into the shed 23 and the guide channel 33. As soon as the reed 10 has reached its rear dead center position, a filling thread is introduced into the guide channel 33 between the blades 32 and the reed teeth 11 by the fluid flowing through the main nozzle and the auxiliary nozzles 35. In this connection the blades 32, the reed teeth 11, and the first warp-thread rest rail 30 see to it that the stream of fluid remains concentrated so that it does not lose the effective action necessary for the transporting of the filling thread through the shed of the loom.

Upon the following forward movement of the reed 10 into the position shown in dot-dash lines in FIG. 1, the blades 32 move upward out of the shed 23. In this way the filling thread which has been previously introduced is pushed by the teeth 11 of the reed 10 against the fell 26, the upper group of warp threads 21 preventing the filling thread, which has been introduced, from following along in the upward movement of the blades 32. Therefore, the filling thread slides downward relative to the reed teeth 11 out of the guide channel 33. When the reed 10 has assumed the position shown in dot-dash lines in FIG. 1, the filling thread is beaten by the reed teeth 11 at the place 26 against the cloth 22 which has already been produced, said place being in the immediate vicinity of the temples 27.

After the filling thread has been beaten against the cloth 22, the reed 10 moves back in opposite direction into the position which permits the introduction of another filling thread after a shed change, the blades 32 again extending from above into between warp threads 21 of the upper group of warp threads. The processes described are then repeated periodically.

It is clear that the reed 10 with the parts 30 and 31 fastened to it need carry out, in addition to the reciprocating movement, only a relatively small component of movement transverse thereto, i.e. in vertical direction, in order to enable the channel forming blades 32 to emerge from the shed 23 upon the beating up of the filling thread and evade the temples 27 so that no collision takes place between the channel forming blades 32 and the temples 27.

Figure 3:
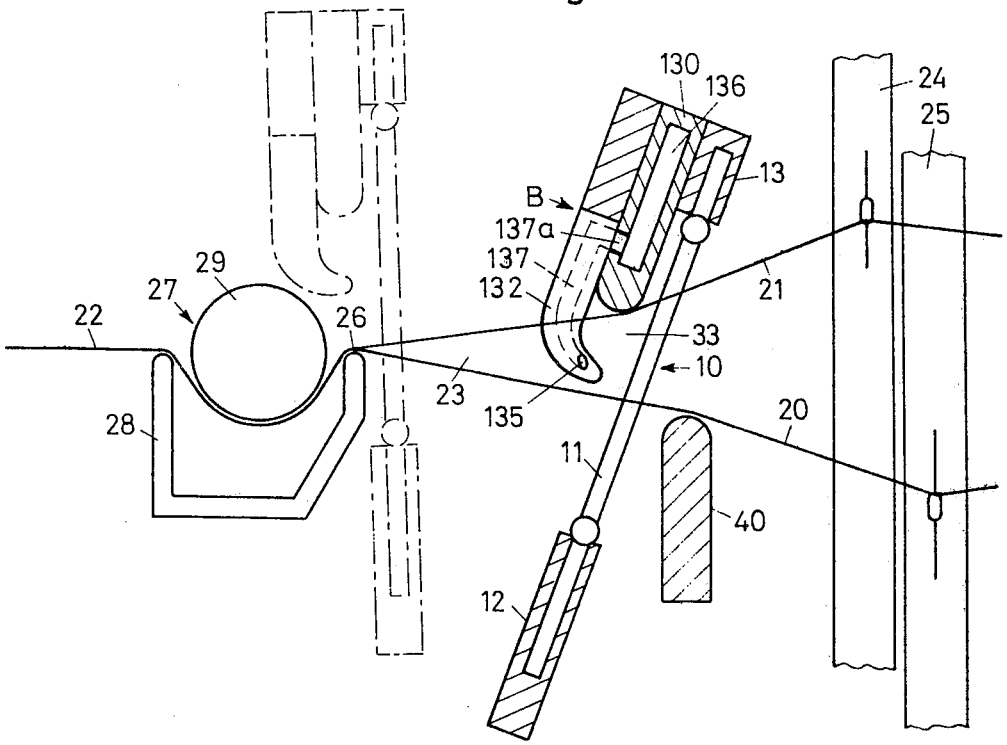
FIG. 3 is a view similar to FIG. 1 of a second embodiment of the loom in accordance with the invention.
Figure 4:
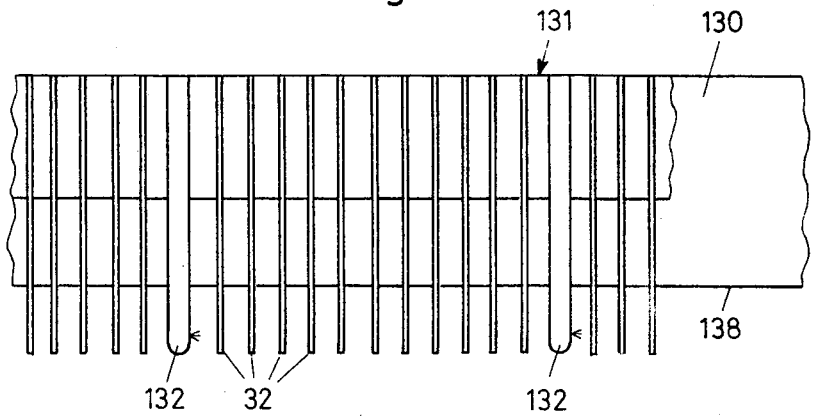
FIG. 4 is a partial view seen in the direction of the arrow B in FIG. 3.

The second embodiment, which is shown in FIGS. 3 and 4 differs as follows from the embodiment described above:

Instead of the first warp thread rest rail 30 having a saw toothed rest edge 38 and the nozzle openings 35, there is provided a rail 130 which has a linearly extending rest edge 138 (FIG. 4) for the warp threads 21 of the upper group of warp threads and no nozzle openings. In the comb 31 which has the individual channel forming blades 32 some of the blades are replaced by hollow fingers which have a lateral nozzle opening 135. The hollow space 137 of each finger 132 is in communication via a bore hole **137*a* with the hollow space 136 of the warp thread rest rail 130. The fingers 132 which are provided with the nozzle openings 135 are arranged, spaced uniformly apart, between groups of flat plates 32, shown in FIG. 4. The direction of emergence of each nozzle opening 135 is such that the emerging stream of fluid enters the guide channel 33** for the introduction of the filling thread and supports the stream of fluid produced by the main nozzle (not shown). The rest of the development is the same as in the case of the first embodiment.

Figure 5:
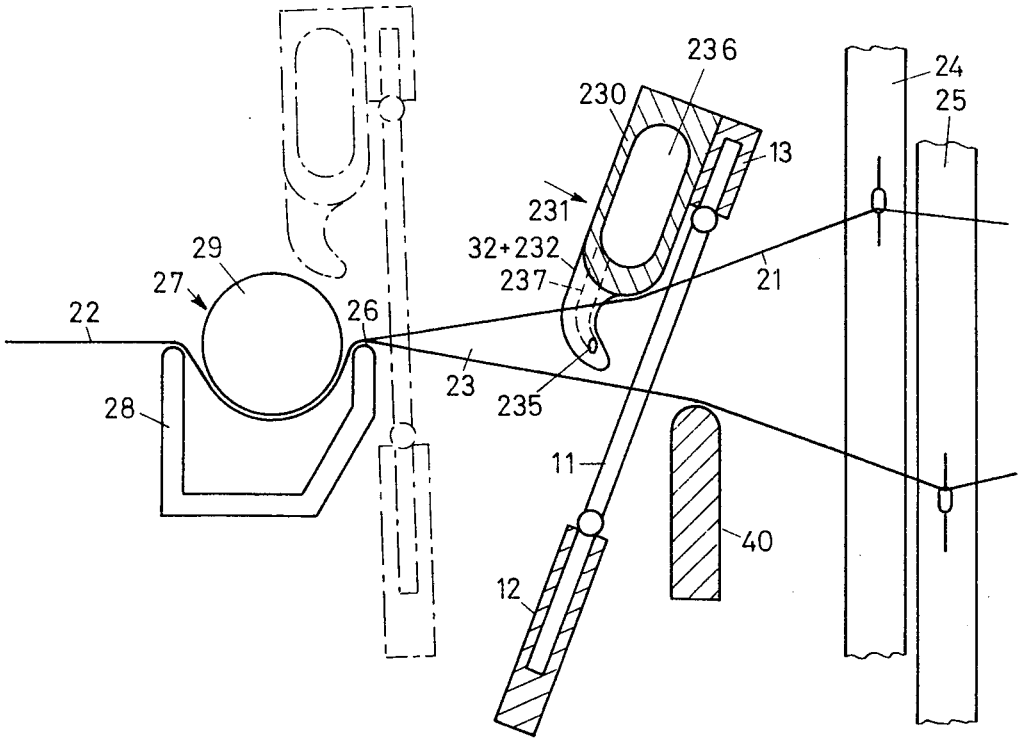
FIG. 5 shows another embodiment of the loom in a view similar to FIG. 1.

FIG. 5 shows another embodiment in which a comb 231 which has the channel forming blades is simultaneously developed as warp thread rest rail. The comb 231 has a profiled rail 230 which is provided with a hollow space 236 and on which the channel forming blades are arranged. Some of the blades, similar to the embodiment of FIGS. 3 and 4, are developed as hollow fingers 232, each of which has a nozzle opening 235 which is connected with the hollow space 236 of the profiled rail 230 via the hollow space 237 of the finger 232. The direction of emergence of the nozzle openings 235 is such that the emerging jet of fluid enters the guide channel 33 for the filling thread to be introduced, which is formed between the blades and the reed teeth 11. The rest of the development is the same as in the case of the first embodiment.

Thus it will be appreciated that the loom according to this invention has channel forming blades arranged on the side of the reed facing the fell, a comb arranged along the top slat of the reed, a movement of the blades obliquely forward and upward, and an entering of and withdrawing from the shed by the blades.

It will be appreciated that various changes and modifications may be made within the skill of the art without departing from the spirit and scope of the invention illustrated, described, and claimed herein.

What is claimed is:

1. Loom having a means for inserting filling threads into a shed of warp threads by means of a gaseous fluid and having a reed for beating up the inserted filling threads, a supporting and drive mechanism for the reed, and temples for spreading the cloth in the widthway direction, the means for inserting the filling threads comprising a comb of parallel channel forming blades adapted to move with the reed and form a guide channel for the insertion of the filling threads by said gaseous fluid, the comb of channel forming blades being arranged on the side of the reed facing the fell of the cloth, and being carried by a slat of the reed which is remote from the supporting and drive mechanism for the reed and above the warp threads, said blades extending from the slat downwardly towards the warp threads, said supporting and drive mechanism including a shaft mounting the reed, said shaft having an axis of rotation positioned below the warp threads and forwardly of the fell so that said reed is moved through an arc which positions the channel forming blades within the warp shed during insertion of the weft and above the temples and the plane of the warp during beat-up of the weft.

2. Loom having a means for inserting filling threads into a shed of warp threads by means of a gaseous fluid and having a reed for beating up the inserted filling threads, a supporting and drive mechanism for the reed, and temples for spreading the cloth in the widthway direction, the means for inserting the filling threads comprising a comb of parallel channel forming blades adapted to move with the reed and form a guide channel for the insertion of the filling threads by said gaseous fluid, the comb of channel forming blades being arranged on the side of the reed facing the fell of the cloth, and being carried by a slat of the reed which is remote from the supporting and drive mechanism for the reed and above the warp threads, said blades extending from the slat downwardly towards the warp threads, each of said channel forming blades has the shape of a finger which, from its fastened point at one end portion, extends substantially parallel to reed teeth and then at its other end portion extends towards the reed to form the guide channel for the fluid between the blade comb and the reed, and an outlet opening for the filling thread introduced between the free end of each channel forming blades and the reed, the beating up movement of the reed providing a swinging motion rotating around a center of rotation that is positioned on the loom at least as much forwardly as is said fell, so that in the filling thread beating up position the channel forming blades are positioned above the temples and withdrawn from the shed.

3. The loom according to claim 2 in which a first warp-thread rest rail is arranged along the comb having the channel forming blades, said rail contacting and aligning the group of warp threads facing away from the supporting and drive mechanism of the reed when the shafts are in the open-shed position and when the reed has moved away from the fell of the cloth.

4. The loom according to claim 3 in which said first warp thread rest rail has at least one hollow space therein for feeding fluid to a plurality of nozzles which discharge into the guide channel the fluid for the introduction of the filling thread, said hollow fingers provided with the nozzle openings arranged between groups of channel forming blades and each hollow finger connected with the hollow space of the warp thread rest rail for passage of the fluid therethrough.

5. The loom according to claim 3 in which a second warp thread rest rail is arranged in fixed position between the reed and shafts for changing the shed, said rail contacting and aligning into the same position the group of warp threads facing the supporting and drive mechanism of the reed when the shafts are in the open-shed position.

* * * * *